US005659839A

United States Patent [19]

Mizude et al.

[11] Patent Number: 5,659,839

[45] Date of Patent: Aug. 19, 1997

[54] VOLTAGE CONTROL APPARATUS FOR CONTROLLING A CHARGER IN AN IMAGE FORMING APPARATUS

[75] Inventors: Kazuhiro Mizude; Masahiro Tsutsumi; Hiroyuki Hazama; Masaru Watanabe; Hidehiro Tabuchi; Hidekazu Sakagami, all of Osaka, Japan

[73] Assignee: Mita Industrial Co. Ltd., Japan

[21] Appl. No.: 540,884

[22] Filed: Oct. 11, 1995

[30] Foreign Application Priority Data

Oct. 12, 1994 [JP] Japan ..... 6-246036
Oct. 13, 1994 [JP] Japan ..... 6-247542

[51] Int. Cl.[6] ..... G03G 15/02

[52] U.S. Cl. ..... 399/50

[58] Field of Search ..... 355/208, 219, 355/221, 210, 211, 216, 214; 399/48, 128, 50, 168, 173, 171

[56] References Cited

U.S. PATENT DOCUMENTS

| | | | |
|---|---|---|---|
| 4,796,064 | 1/1989 | Torrey | 399/50 |
| 4,939,542 | 7/1990 | Kurando et al. | 399/50 |
| 5,173,734 | 12/1992 | Shimizu et al. | 399/50 |
| 5,243,383 | 9/1993 | Parisi | 399/50 |
| 5,355,197 | 10/1994 | Hopkins | 399/50 |
| 5,383,005 | 1/1995 | Thompson et al. | 399/50 |
| 5,469,243 | 11/1995 | Saitoh et al. | 355/219 X |
| 5,471,283 | 11/1995 | Irihara et al. | 355/219 X |
| 5,508,787 | 4/1996 | Hasegawa et al. | 355/208 |
| 5,534,977 | 7/1996 | Saitoh et al. | 399/50 |
| 5,572,295 | 11/1996 | Sakagami et al. | 399/50 |

*Primary Examiner*—S. Lee

*Attorney, Agent, or Firm*—Beveridge, DeGrandi, Weilacher & Young, LLP

[57] ABSTRACT

An electrographic copying machine has a photoreceptor drum which moves so that a photosensitive layer on its surface is successively charged, exposed, developed and charge-removed. The photosensitive layer is made of an amorphous material. The drum surface is charged by a charger before a latent image is formed thereon through exposure. A voltage generator is provided which supplies the charger with a voltage to charge the drum surface. It takes time for the potential of the charged drum surface at the developing section to reach a predetermined potential from a potential higher than the predetermined potential due to a rise characteristic of the surface potential. A controller is provided which corrects an output voltage value of the voltage generator to a voltage value necessary for the drum surface to be charged at the predetermined potential in a predetermined number of charging operations performed until the surface potential reaches the predetermined potential.

18 Claims, 8 Drawing Sheets

VOLTAGE CONTROL APPARATUS FOR CONTROLLING A CHARGER IN AN IMAGE FORMING APPARATUS

BACKGROUND OF THE INVENTION

1. Field of the Invention

The present invention relates to an image forming apparatus such as an electrographic copying machine, a printer and a facsimile machine of a type in which after an electrostatic latent image is formed on a charged surface of an electrostatic latent image carrier such as a photoreceptor drum, the electrostatic latent image is developed into a toner image.

2. Description of the Prior Art

Typically, an electrographic copying machine is provided with, for example, a photoreceptor drum rotating at a constant speed, and along the rotation direction of the drum, a charging section, an exposing section, a developing section, a transferring section, a cleaning section and a charge removing section are arranged. The copying operation is performed in the following manner: First, the drum surface is charged at the charging section, then, the drum rotates, and when the charged drum surface passes the exposing section, light carrying the image information of the original exposes the drum surface. By the exposure light, an electrostatic latent image is formed on the drum surface.

In the developing section, a developer unit is arranged to face the drum surface. When the drum rotates to reach the developing section, toner supplied from the developer unit adheres onto the electrostatic latent image formed on the drum surface, thereby obtaining a toner image. At the transferring section, the toner image is transferred onto the surface of a copy sheet supplied from a paper feeding section. After the transfer is completed, the residual toner on the drum surface is removed at the cleaning section and the electrostatic latent image formed on the drum surface is removed by irradiating charge removing light onto the entire surface of the drum at the charge removing section to optically attenuate the surface potential.

In the electrographic copying machine structured as described above, a charger employing a corona discharge method is arranged to face the drum surface in the charging section. In this arrangement, when a copy button is depressed in the standby state of the copying machine, a high voltage of normally approximately 4 to 6 kV is applied to a discharging main wire of the charger to generate a corona discharge, thereby applying a charge to the drum surface. Conventionally, in order to supply the high voltage to the discharging main wire, a transformer board incorporating a transformer for generating a high voltage is provided between the main wire and the power source, and the output of the transformer board is controlled by a main circuit board so as to take a substantially constant value.

In recent years, amorphous silicon materials have been widely used as photosensitive materials for the above-described drum type or other types of electrostatic latent image carriers provided in image forming apparatuses of this type. As the result of experiments and examinations, the amorphous silicon materials are regarded as inferior in rise characteristic of the surface potential in charging unlike conventional arsenic selenium materials.

Specifically, it is considered that the rise condition of surface potential of the drum in charging is such that, as shown by a curve $a_1$ of FIG. 12, it takes a long time for the surface potential to reach a stable potential after the depression of the copy button in the initial operation of the copying process and that, as shown by a curve $b_1$ of FIG. 12, from a relationship with the length of a shelf time from the end of a copying process to the start of the next copying process, the longer the shelf time is, the more the rise of the drum surface potential deteriorates.

For this reason, it is considered that in electrostatic latent image carriers using amorphous silicon materials, in reducing the length of the first copying i.e. a copying operation performed for the first time in order to increase the copying efficiency, as shown in FIG. 12, the drum surface potential is still lower than the stable potential at a point of time $t_f$ when the first copying (copying of the first copy sheet) is performed, and that the rise of the surface potential further deteriorates when the shelf time from the end of a copying process to the start of the next copying process exceeds an hour.

To solve the problems of photoreceptor drums having such characteristics, in Japanese Patent Application H6-2557 directed particularly to amorphous silicon-made photoreceptors inferior in rise of the charging, the inventors of the present invention proposed to correct the control amount of the transformer board so that the charging stays flat until the surface potential stabilizes. Moreover, in Japanese Patent Application H6-2558 the present inventors proposed to vary the correction value according to the shelf time during which the drum is left deactivated.

However, the present inventors further carried out detailed experiments and verifications and found that not all the amorphous silicon materials are inferior in the above-described initial charging characteristic and shelf time characteristic. Specifically, some materials have a characteristic such that, as shown in a curve $a_2$ of FIG. 12, in the initial operation of the copying process, the surface potential is rapidly activated in contrast to the conventional recognition and temporarily exceeds the stable potential to overshoot, and thereafter, the surface potential gradually returns to the stable potential and remains stable.

In the case of drums having such characteristics, it is confirmed that the shelf time characteristic is such that the longer the shelf time is, the more rapidly the drum surface potential rises as shown by a curve $b_2$ of FIG. 12. In the case of drums having such a characteristic, the surface potential is higher than the stable potential in the copying of the first copy sheet. For this reason, the charge of the electrostatic latent image is excessive, so that the electrostatic latent image cannot be developed into an excellent toner image at the developing section.

Therefore, if continuous copying is performed with such an arrangement, since the surface potential is high during copying of several sheets after the start of the copying, obtaining copy images of desired quality is difficult until the completion of copying of the several sheets that the drum surface potential reaches the normal value. Moreover, only by the above-described solution of the prior art, the surface potential is over-corrected and the charging characteristic may become all the worse for the over-correction.

SUMMARY OF THE INVENTION

An object of the present invention is to provide an image forming apparatus in which an excessive rise of the surface potential of the electrostatic latent image carrier to over a stable potential in the beginning of image formation due to the effect of the shelf time after an operation, is corrected so that images of excellent quality are obtained from the copying of the first sheet in the beginning of an image forming operation and in a continuous copying operation irrespective of the shelf time.

An image forming apparatus of the present invention is provided with the following: an electrostatic latent image carrier which moves so that a photosensitive layer on its surface is successively charged, exposed, developed and charge-removed, said charging, exposure, development and charge removal constituting an image forming process; a charger which charges a surface of the electrostatic latent image carrier; voltage generating means for supplying the charger with a voltage to charge the surface of the electrostatic latent image carrier; and controlling means for correcting an output voltage value of the voltage generating means to a voltage value necessary for the surface of the electrostatic latent image carrier to be charged at a predetermined voltage in a predetermined times of charging operations performed until a potential of a charged surface of the electrostatic latent image carrier at a developing section reaches the predetermined potential from a potential higher than the predetermined potential due to a rise characteristic of the potential of the surface of the electrostatic latent image carrier.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
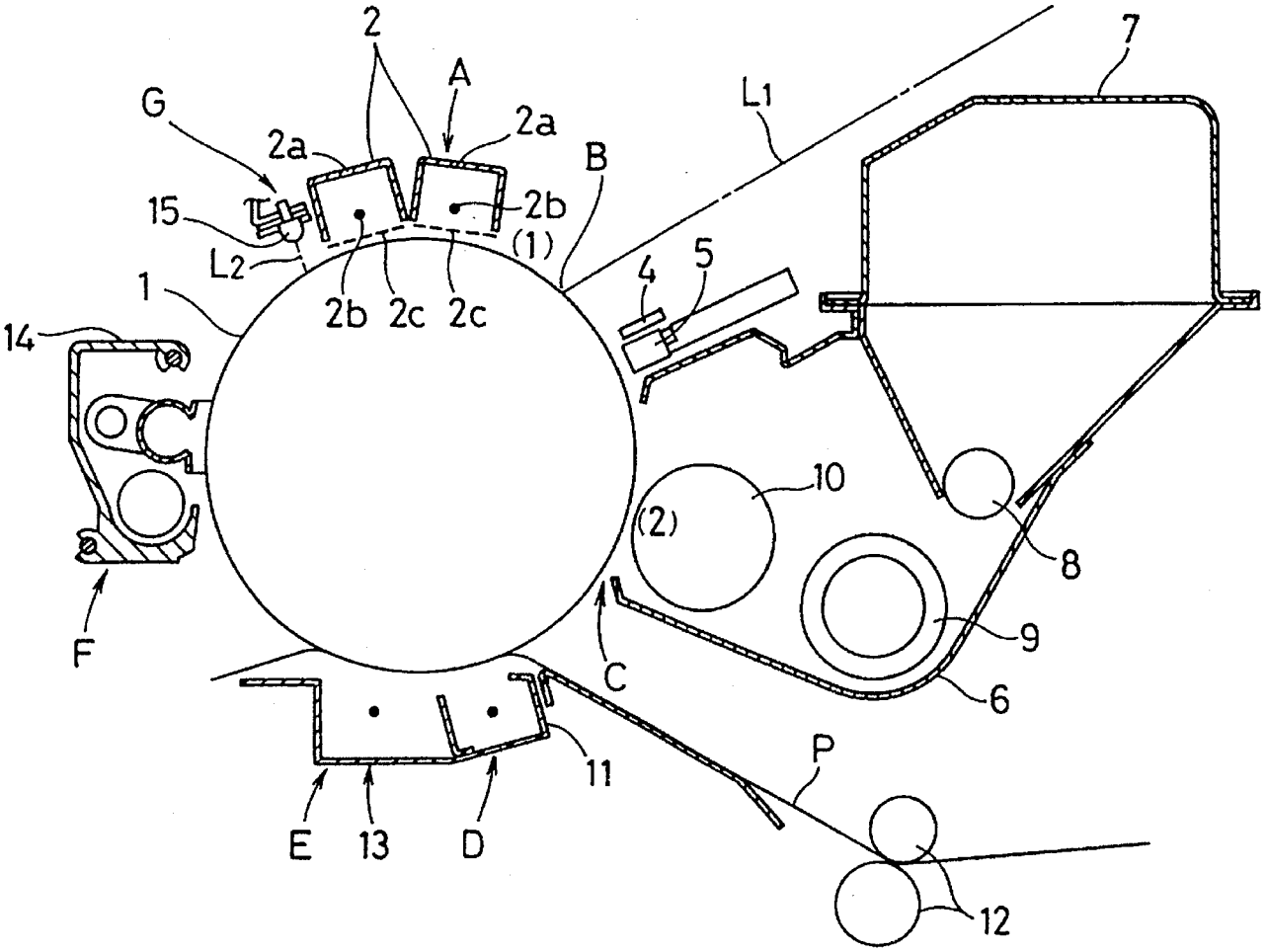
FIG. 1 is a front view schematically showing the arrangement of a relevant portion of a copying machine embodying the present invention.

Hereinafter, an embodiment where the present invention is employed in an electrographic copying machine will be described with reference to the drawings. Referring to FIG. 1, there is schematically shown the arrangement of the electrographic copying machine. Reference numeral 1 represents a photoreceptor drum serving as an electrostatic latent image carrier. The drum 1 includes a drum base made of a metal such as aluminum on which an amorphous silicon photosensitive material is deposited, and is rotated clockwise in the figure at a constant speed by a motor (not shown) of a driving system. In the periphery of the drum 1, a charging section A, an exposing section B, a developing section C, a transferring section D, a separating section E, a cleaning section F and a charge removing section G are arranged in this order in the rotation direction (movement direction) of the drum 1.

In the charging section A, a pair of chargers 2 are arranged adjacent to each other. The chargers 2 are arranged to look toward the axial center of the drum and tube close to the drum surface to face it. The surfaces of the chargers 2 which face the drum 1 are open. In a shield case 2*a* arranged in parallel with the drum axis, a charging wire 2*b* composed of a fine tungsten wire is stretched along the length of the shield case 2*a*, and a grid electrode 2*c* made of a conductive material and having a plurality of openings is arranged at the open surface of the shield case 2*a*.

Figure 2:
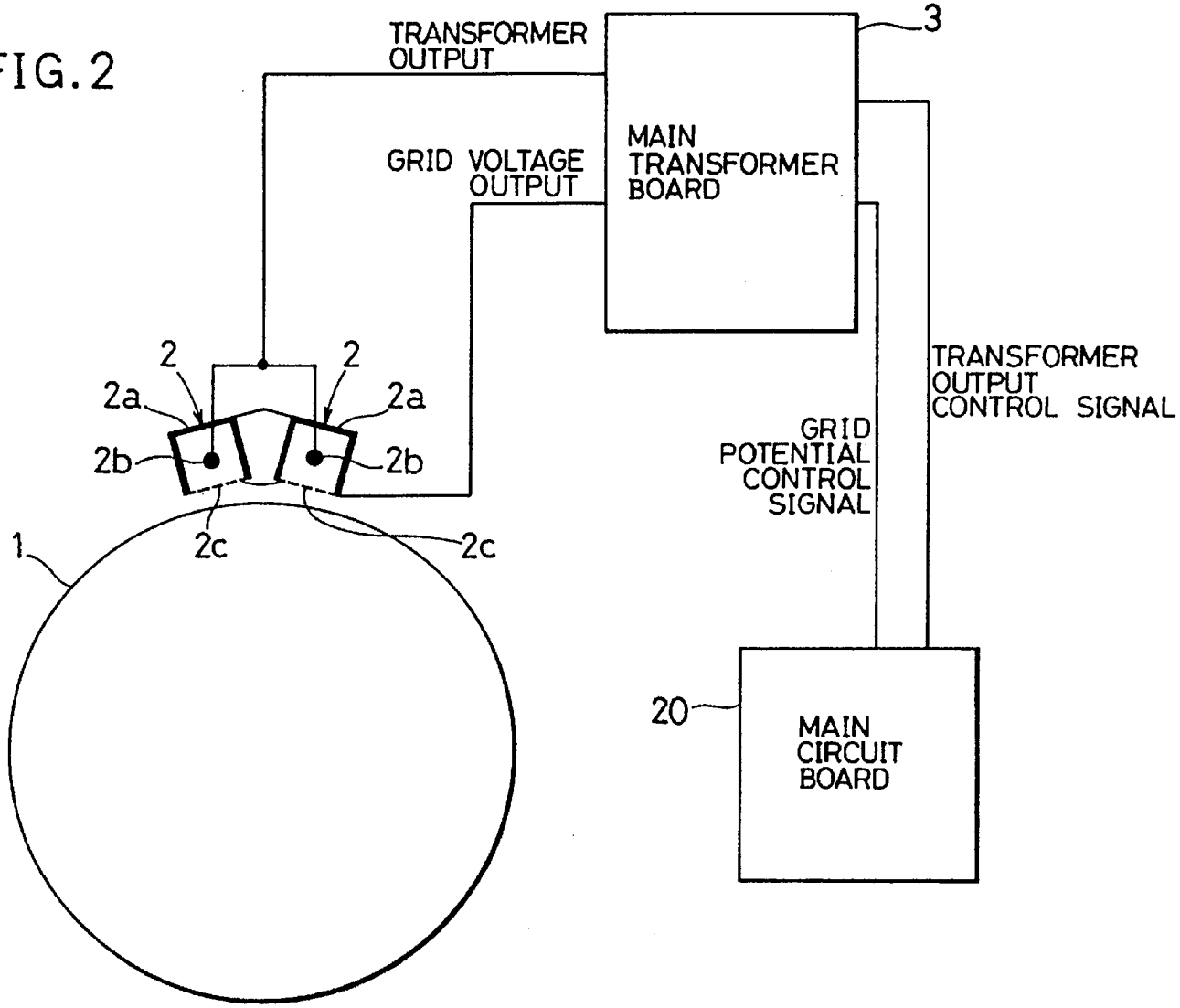
FIG. 2 schematically shows a control system of chargers.

Referring to FIG. 2, there is shown a control system of the chargers 2. As shown in the figure, the charging wires 2*b* are connected to a main transformer board 3 having a transformer for generating a high voltage, and a high voltage of normally approximately 4 to 6 kV is applied by the main transformer board 3. Returning to FIG. 1, when the high voltage is applied to the chargers 2 by the main transformer board 3, a corona discharge is generated to supply a charge to the drum surface. The surface potential of the drum 1 thus charged is normally approximately 1000 V.

When the drum 1 rotates so that the charged surface reaches the exposing section B, a reflected light $L_1$ of an original image is irradiated on the charged surface through a non-illustrated optical system to expose the surface. In this case, only the surface potential of the exposed portion is reduced by optical attenuation in correspondence with the exposure amount, so that an electrostatic latent image is formed.

A potential sensor 4 is arranged just in front of the developing section C in the drum rotation direction. The measurement value of the potential sensor 4 can be used in order that the charging potential of the drum surface at the developing section C is a target value. For the following reason, the drum surface potential is measured just in front of the developing section C:

Since the potential (1000 V) of the drum surface charged at the charging unit A is dark-decayed while the drum 1 is rotating to the developing section C, the surface potential is reduced to approximately 820 V when the drum surface reaches the developing section C. Conversely, the surface potential at the developing section C is necessarily approximately 820 V, and the voltage applied to the chargers 2 at the charging section A is set so that the surface is charged to a potential (1000 V) allowing for the dark decay. In order that the surface potential of the drum surface at the developing section C is the target value 820 V, the measurement value of the surface potential at the potential sensor 4 is necessarily 850 V. Therefore, the charging potential of the charging section A is set to 1000 V so that the measurement value is 850 V. The setting of the voltage will be described later.

Reference numeral 5 represents an image erasing blank lamp arranged adjacent to the potential sensor 4. The blank lamp 5 is constituted by arrays of light emitting diodes (LEDs). When the user intends to erase a part of an electrostatic latent image for a purpose such as specifying an image area, the blank lamp 5 selectively turns on necessary LEDs so that the portion of the electrostatic latent image irradiated by the LEDs which have been turned on is optically attenuated and erased. The blank lamp 5 is not used in the normal copying.

In the developing section C, a developer unit 6 and a toner hopper 7 which supplies toner to the developer unit 6 are arranged. With this arrangement, toner contained in the toner hopper 7 is supplied into the developer unit 6 by a necessary amount through a sponge roller 8. The toner and carrier (iron powder) are agitated by an agitating roller 9 in the developer unit 6, and the toner held by the carrier adheres to the surface of the developing roller 10. When the portion of the drum 1 on which an electrostatic latent image is formed reaches the developing section C, the toner in the developer unit 6 electrically adheres to the drum surface according to the electrostatic latent image through the developing roller 10. Thereby, a toner image is formed.

In the transferring section D, a transfer charger 11 is arranged. When the drum 1 reaches the transferring section D, a sheet P is fed from a paper feeding section (not shown) onto the drum surface through paper feeding rollers 12, and a voltage of a polarity opposite to that of the toner is applied to the transfer charger 11 to transfer the toner image formed on the drum surface to the sheet P. At the separating section E, a separating charger 13 is arranged. The separating charger 13 applies an AC electrical field to the drum surface to thereby release the sheet P from being attracted to the drum 1, so that the sheet P on which the toner image has been transferred is separated from the drum 1.

In the cleaning section F, a cleaning unit 14 is arranged. The cleaning unit 14 removes things such as toner adhering to the drum surface from the drum surface by scrubbing the drum surface. The residual toner on the drum surface reaches the cleaning section F and is removed by the cleaning unit 14. Then, at the charge removing section G, a charge irradiating light $L_2$ of a charge removing lamp 15 irradiates the drum surface to optically attenuate the surface potential of the drum 1, so that the charge is removed.

Then, the drum 1 returns to the charging section A to be ready for the next copying operation. When the continuous copying is set, the above-described copying process is repeated an arbitrarily set number of times.

Figure 3:
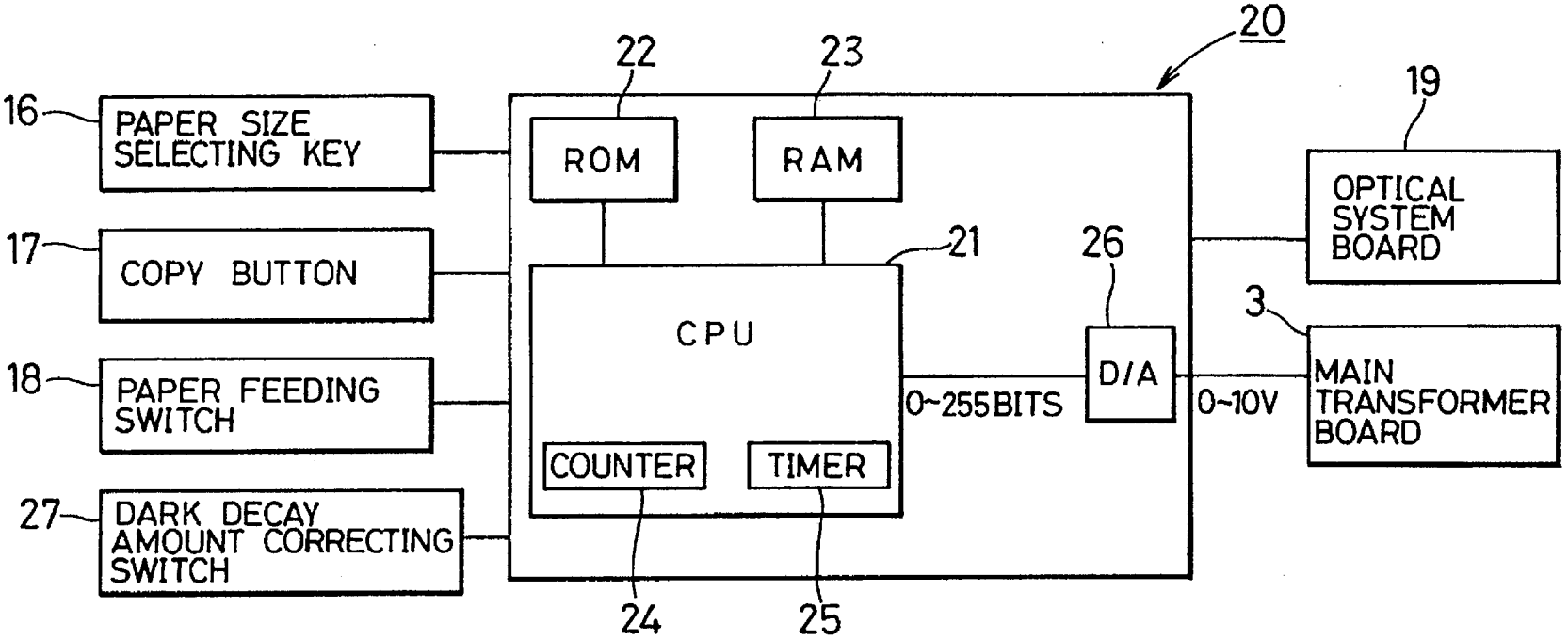
FIG. 3 is a block diagram showing a control system and an operation system of the copying machine.

Referring to FIG. 3, there is shown a block diagram of a control system and an operation system. Reference numeral 16 represents a paper size selecting key used to select a size from among the sizes shown in Table 1. Reference numeral 17 represents a copy button serving as an operation means used to start a copying operation. By pressing the copy button 17, the above-described copying process is executed. Reference numeral 18 represents a paper feeding switch provided in the vicinity of the paper feeding rollers 12. Reference numeral 19 represents an optical system board for controlling the optical system.

Reference numeral 20 represents a main circuit board as a controlling means provided with a microcomputer. The main circuit board 20 is provided with a central processing unit (CPU) 21, a read only memory (ROM) 22 and a random access memory (RAM) 23 for inputting and outputting control data to the CPU 21. In the CPU 21, a counter 24 for counting the number of copyings based on a detection signal of the paper feeding switch 18 and a timer 25 for counting the shelf time are arranged in the form of software.

Figure 12:
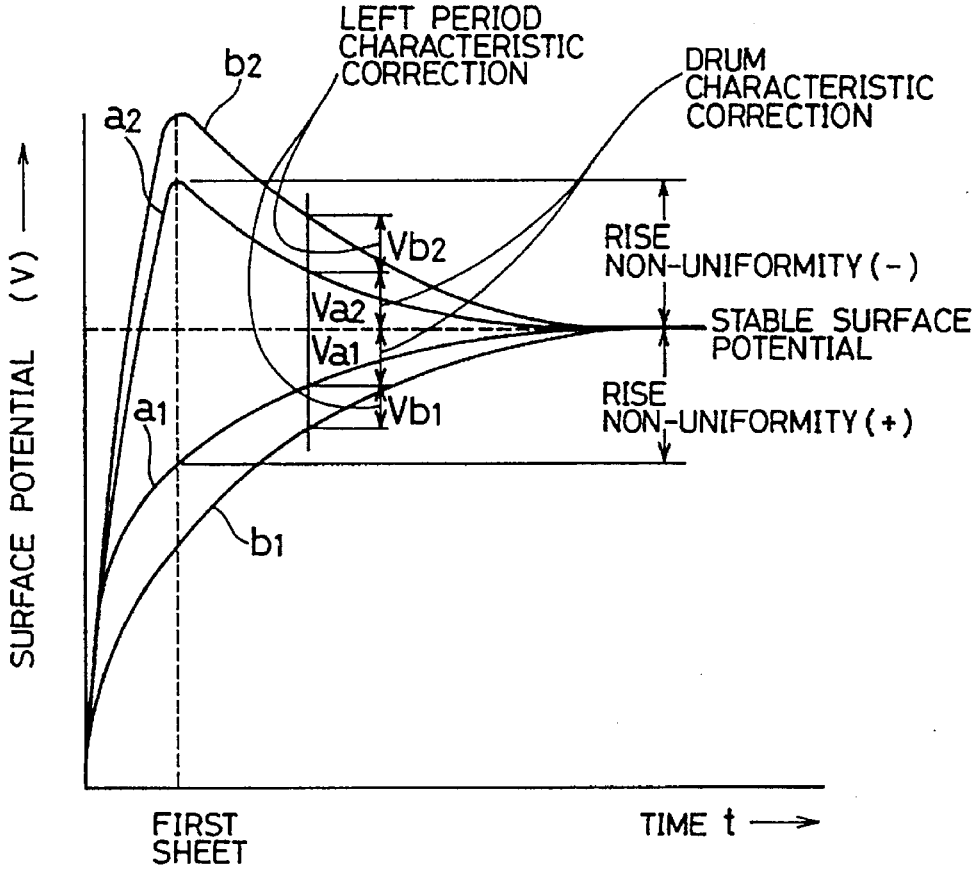
FIG. 12 is a diagram showing rise conditions of the surface potential of the photoreceptor drum having an amorphous silicon-made photosensitive layer in voltage application.

After the copying process is started, the CPU 21 controls the program so that a transformer output control signal for correcting an output value of the main transformer board 3 to a voltage value necessary for charging the drum surface at a stable potential level is transmitted to the main transformer board 3 through a digital to analog (D/A) converter 26 incorporated in the main circuit board 20 based on input data from the paper size selecting key 16, the copy button 17 and the paper feeding switch 18 in the charging operation performed predetermined times until the surface potential of the drum 1 reaches the stable potential level shown by the dotted line of FIG. 12.

Figure 4:
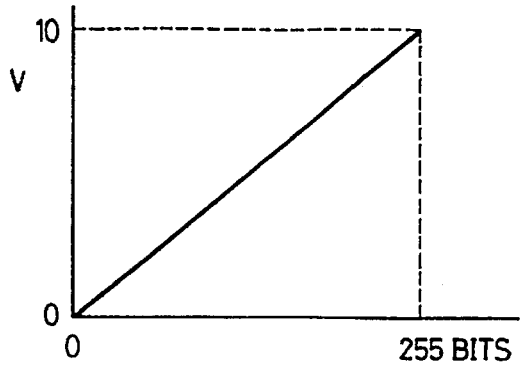
FIG. 4 is a diagram showing a relationship between an output value of a CPU and a D/A conversion value thereof.

Referring to FIG. 4, there is shown a relationship between a digital data input value (axis of abscissa) and an analog output value (axis of ordinate) provided from the CPU 21 to the D/A converter 26 in this case. As shown in the figure, the output of the CPU 21 is set to 0 to 255 bits, and a transformer output control signal which is a D/C-converted value thereof proportionally corresponds to 0 to 10 V.

Figure 5:
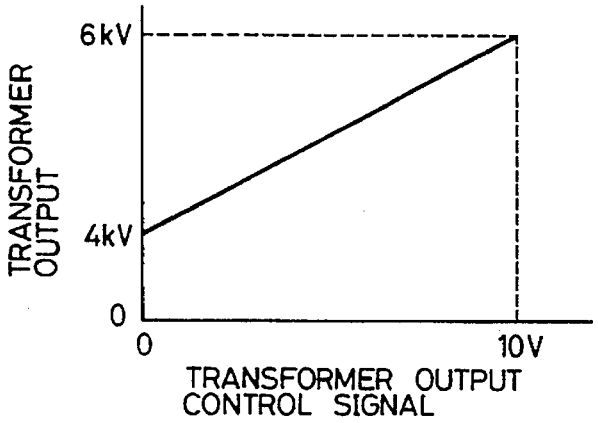
FIG. 5 is a diagram showing a relationship between a transformer output control signal and a transformer output.

Referring to FIG. 5, there is shown a relationship between a D/A-converted transformer output control signal and a transformer output of the main transformer board 3. As shown in the figure, the output of 0 to 10 V of the transformer output control signal outputted from the main circuit board 20 proportionally corresponds to the voltage of 4 to 6 kV applied to the chargers 2 by the main transformer board 3.

Specifically, referring to FIG. 12, at the time of the charging in the copying process from the copying of the first sheet to the time when the drum surface potential reaches the stable potential, there is a difference $Va_1$ or $Va_2$ between the drum surface potential and the stable potential of that time based on the rise characteristic (hereinafter, referred to as drum characteristic) of the drum 1 having a photosensitive layer made of an amorphous silicon material. When there is some shelf time, there is a difference $Vb_1$ or $Vb_2$ between the drum surface potential of that time based on the shelf time characteristic and the surface potential based on the drum characteristic.

In the electrographic copying machine thus structured, since the photosensitive layer of the drum 1 is made of an amorphous silicon material as mentioned previously, as shown by the curves $a_1$ and $a_2$ of FIG. 12, the rise of the surface potential in the beginning of the copying operation is non-uniform compared to the stabilized surface potential. Moreover, as shown by the curves $b_1$ and $b_2$, the non-uniformity in rise of the surface potential is more remarkable according to the length of the shelf time after the completion of the copying operation. In this regard, the present inventors carried out detailed researches and examinations and found that the necessary surface potential correction amount in charging attributed to the drum 1 itself correlates with the dark decay amount of the photoreceptor layer of the drum 1.

Figure 6:
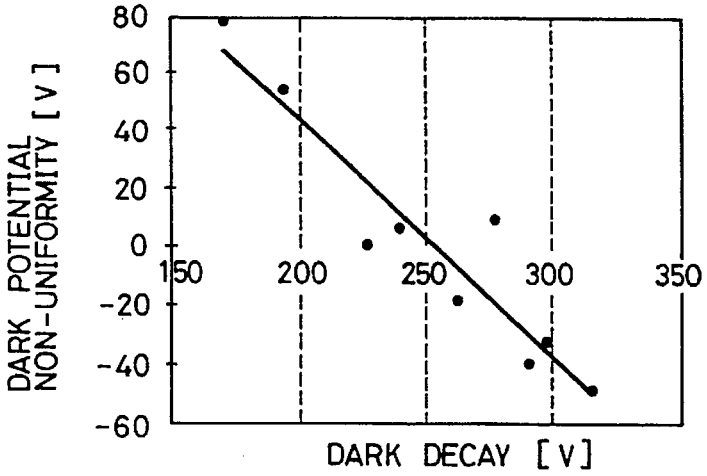
FIG. 6 is a diagram showing a relationship between dark decay and dark potential non-uniformity of a photoreceptor drum based on actual measurements.

Specifically, as shown in FIG. 6, non-uniformities of surface potential rises (potential obtained by subtracting the surface potential of the first copying from the stable surface potential) of drums 1 each made for practical use were measured. As shown by the solid line of FIG. 6, the non-uniformity of surface potential rise of each drum was 0 when the dark decay amount was a little over 250 V but decreased toward the positive direction and deteriorated when the dark decay amount was smaller than that. On the contrary, when the dark decay amount was greater than approximately 250 V, the non-uniformity increased toward the negative side, and the surface potential exceeded the stable potential and rose drastically. The dots of FIG. 6 plot the results of the measurement.

Therefore, in an amorphous silicon drum, the correction amount based on the surface potential characteristic of the drum 1 is varied according to the dark decay amount particular to each drum. In this case, since the dark decay amount of each drum 1 can be detected in advance through measurement, the dark decay amount obtained through measurement is written on some appropriate place of the surface of each drum, and in adjustment, the amount is inputted to the control system by means of a dark decay amount correcting switch 27 such as a ten key in a simulation mode so that it can be used for the correction of surface potential of the drum 1. Alternately, a protrusion of a size corresponding to the dark decay amount may be provided on the drum 1 so that when the drum is attached, the size of the protrusion is read in by a sensing switch provided in the copying machine.

Figure 7:
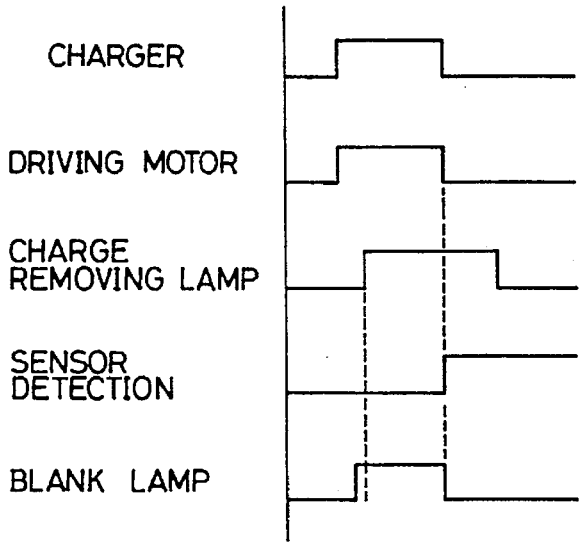
FIG. 7 is a time chart showing an operation timing of each element in a simulation mode in a drum surface potential characteristic measurement.

In a copying machine provided with a potential sensor like this embodiment, the dark decay amount can be actually measured and used for the surface potential correction. Specifically, in the simulation mode, as shown in the time chart of FIG. 7, a predetermined voltage is applied to the chargers 2, and after the driving motor is excited so that the drum 1 makes an arbitrary number of revolutions, for example, substantially one revolution, the motor is stopped and the drum surface potential is detected by the potential sensor 4 from when the motor is stopped. During that time, the charge removing lamp 15 is kept on to prevent the drum surface from being over-charged while the drum 1 is rotating. The blank lamp 5 is also turned on to prevent the drum surface from being developed.

Figure 8:
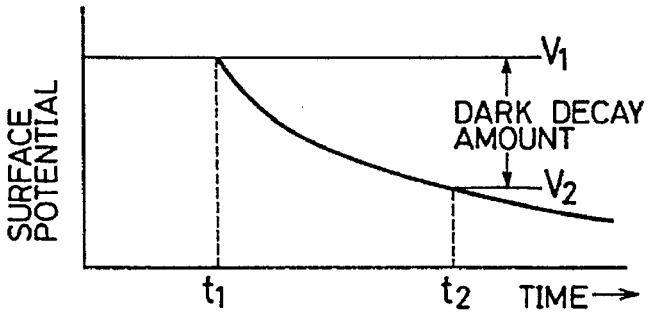
FIG. 8 is a diagram showing a with-time variation in drum surface potential in measuring a dark decay amount of the drum surface potential in a copying machine provided with a potential sensor.

In the graph of FIG. 8, a time $t_1$ represents a motor stop time and a time $t_2$ represents a time after a predetermined period of time has elapsed. At the potential sensor 4, first, a drum surface potential $V_1$ at the time $t_1$ is detected, and then, a drum surface potential $V_2$ at the time $t_2$ after the predetermined period of time has elapsed is detected. The potential difference $V_1-V_2$ is the dark decay amount particular to the drum. Based on the potential difference, the surface potential characteristic of the drum 1 is obtained. The shelf time characteristic in repetitive copying can be obtained by repeating an operation similar to the above operation with a predetermined time interval to obtain data of each copying.

Figure 9:
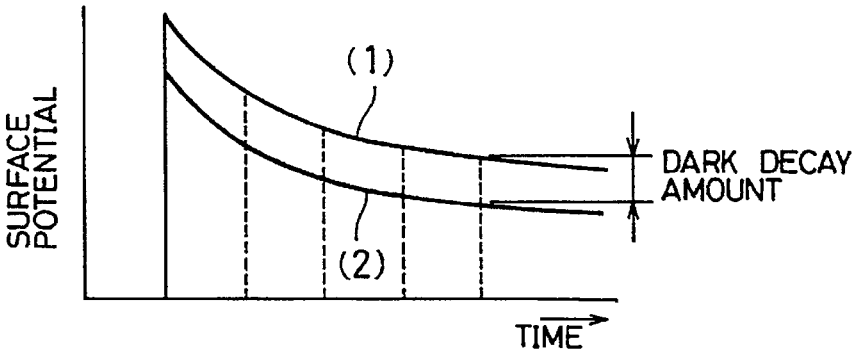
FIG. 9 is a diagram showing a with-time variation in drum surface potential in measuring the dark decay amount of the drum surface potential by using a drum checker.

As another method, a drum checker may be used to measure the drum characteristic. Specifically, in FIG. 1, potential sensors (1) and (2) of drum checkers are arranged in the downstream side of drum rotation direction of the chargers 2 and at the developer unit 6, respectively, and when the drum 1 is charged while being rotated during a set period of time similarly to the above-described method, as shown in the graph of FIG. 9, the drum surface potential detection value of the developer unit side potential sensor (2) takes a value lower than the detection value of the charger side potential sensor (1) by the dark decay amount.

Figure 10:
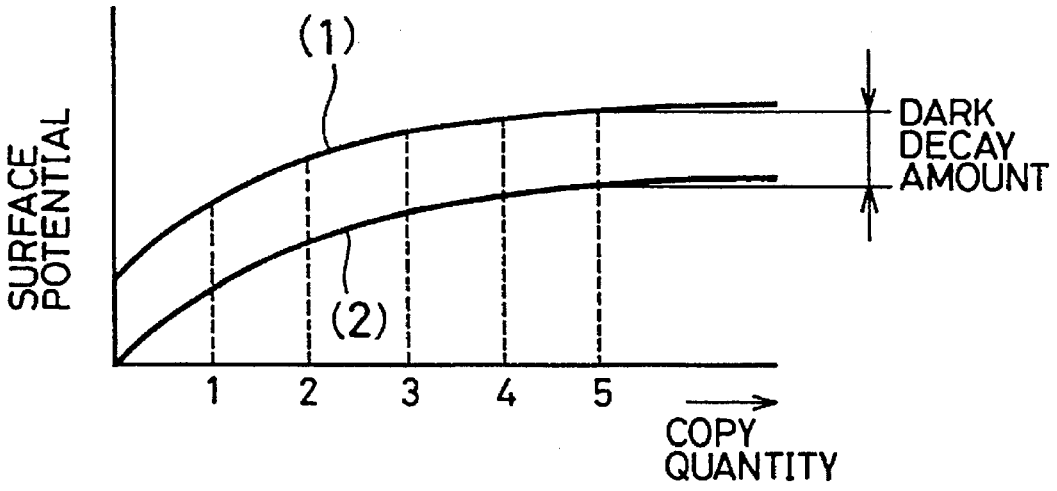
FIG. 10 is a diagram showing a variation in drum surface potential for every copying in measuring a shelf time characteristic of the drum surface potential by using a drum checker.

Thus, the difference between the detection value of the potential sensor (1) and the detection value of the potential sensor (2) is the surface potential characteristic particular to the drum which is the object of the check. This method is advantageous in that the transition of the dark decay amount can be read by the drum checker in real time. To obtain the shelf time characteristic in repetitive copying, an operation similar to the above-described operation is repeated for a predetermined period of time to obtain data of each copying, so that, for example, as shown in the graph of FIG. 10, the shelf time characteristic can be read in real time every copying.

Figure 11:
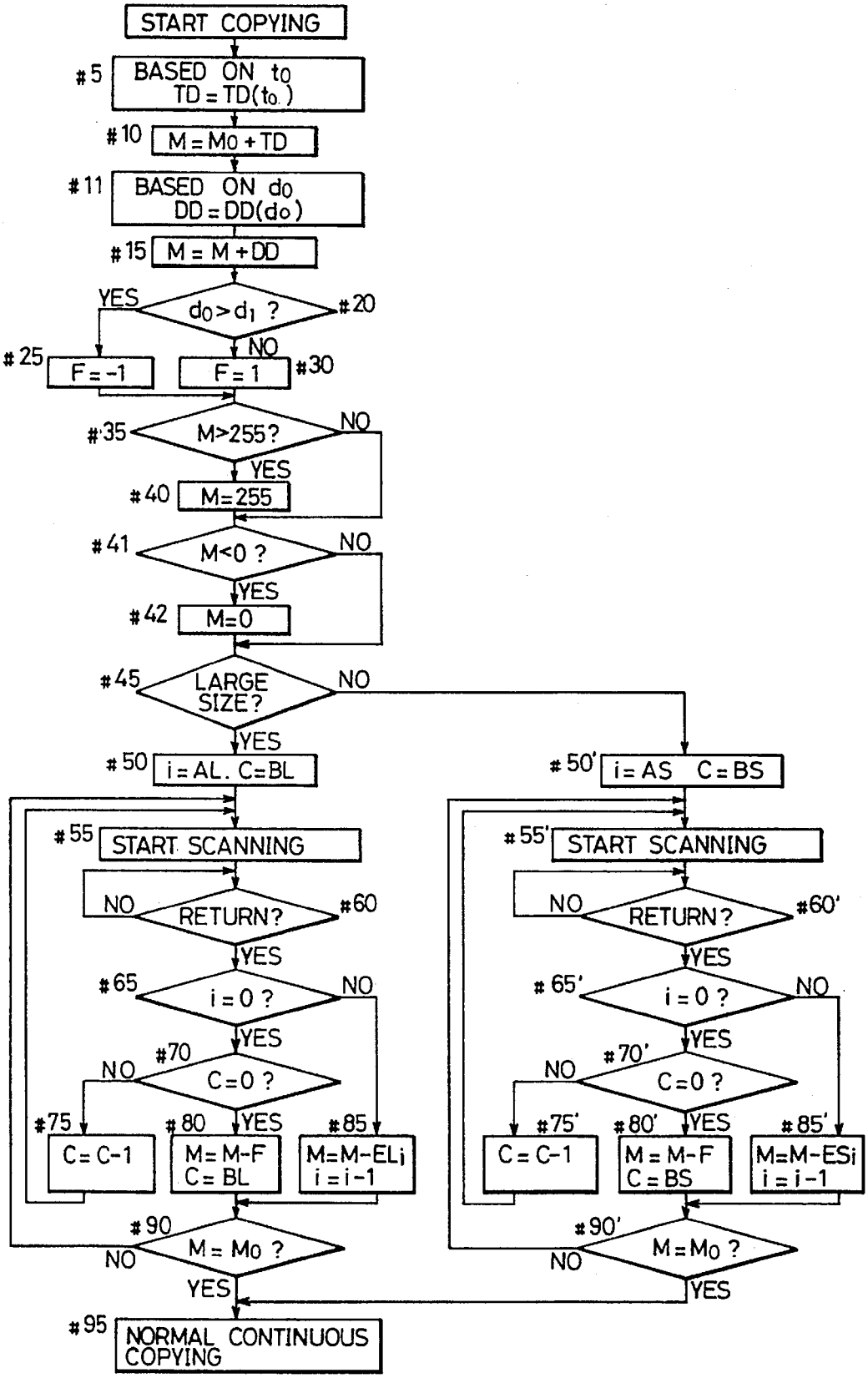
FIG. 11 is a flowchart of a control operation performed by the CPU.

Referring to FIG. 11, there is shown a flow of a control operation performed by the CPU 21 of the main circuit board 20. When the copy button 17 is operated to start a continuous copying operation, the number of copyings is detected by the counter 24 and a shelf time $t_0$ from the end of the previous copying operation obtained by a counting operation of the timer 25 is detected. Then, at step #5, a shelf time characteristic addition data TD corresponding to the shelf time $t_0$ is selected from a table data in the ROM 22. For example, when the shelf time is three minutes, the CPU 21 takes out data corresponding to a shelf time of three minutes from the table data of the ROM 22.

At step #10, when M is a control value to control a transformer output during copying, the shelf time correction value TD (here, TD includes a sign such as + and −) is added to a set transformer output control value $M_0$ (stable surface potential). These control values M and $M_0$ are counted in bits on software and increase in the form of bits a correction amount corresponding to the value of $Vb_1$ or $Vb_2$ of FIG. 12 obtained at that time.

At steps #11 and #15, as the transformer output control value M during copying, a drum characteristic correction value DD corresponding to a dark decay amount $d_0$ particular to the drum is selected from the data table and added to the value to which the shelf time correction value TD was added at step #10. The drum characteristic correction value DD is also stored in bits in the ROM 22 and increases in the form of bits a correction amount corresponding to the value of $Va_1$ or $Va_2$ of FIG. 12 obtained at that time.

At step #20, the dark decay amount $d_0$ particular to the drum detected as described above is compared with a dark decay amount $d_1$ (in FIG. 6, a dark decay amount of approximately 250 V) corresponding to the stable potential which is a set data of the ROM 22, and whether addition or subtraction is performed at the correction of step #80 is determined. At steps #25 and #30, whether data is added or subtracted is decided. Then, when the control value M exceeds a maximum permissible value (255 bits) at step #35, the control value M is set to the maximum value, i.e. 255 bits at step #40. This value is 10 V after the D/A conversion as is apparent from FIG. 4. Therefore, to the charging wires **2*b* of the chargers 2, an application voltage of 6 kV is set from the main transformer board 3 based on the relationship shown in FIG. 5**.

Then, when the control value M is less than a minimum permissible value (0 bit) at step #41, the control value M is set to the minimum value, i.e. 0 bit at step #42. This value is 0 V after the D/A conversion as is apparent from FIG. 4. Therefore, to the charging wires **2*b* of the chargers 2, an application voltage of 4 kV is set from the main transformer board 3 based on the relationship shown in FIG. 5**.

At step #45, the subtraction control is branched based on paper size data inputted from the paper size selecting key 16. In this case, as shown in Table 1, data classified into large and small sizes are stored in the ROM 22 with a predetermined sheet size as the reference. For example, when the original is copied to an A3-size sheet, it is determined that the sheet is of a large size as shown in Table 1 and the process proceeds to step #50. Moreover, when the sheet is, for example, of A4 size, it is determined that the sheet is of a small size and the process proceeds to step #50'.

At step #50, two count variables corresponding to large size sheets are set. Specifically, an initial copy quantity count variable i is set to an initial copy quantity count value AL of the large size sheet, and an interval count variable C is set to an interval count value BL of the large size sheet. In this embodiment, the correction values are gradually reduced after the copying of the first sheet ($t_F$) of FIG. 12. In the copying of several sheets immediately after the copying of the first sheet, since the characteristic radically varies as is apparent from the characteristics $a_1$, $a_2$, $b_1$ and $b_2$ of FIG. 12, the correction values must be largely reduced. AL represents the number of sheets for which the correction values must be largely reduced, and the count variable of AL is i. For example, when the number of sheets AL for which the correction values must be largely reduced is 3, i=3 in the copying of the second sheet succeeding the copying of the first sheet ($t_F$), i=2 in the copying of the third sheet, and i=1 in the copying of the fourth sheet. After the copying of the fifth sheet (i=0), the correction values are reduced by a constant value. The reduction by the constant value is made every predetermined number of sheets. The predetermined number of sheets is the interval count value BL, and its count variable is C.

In this case, the initial copy quantity count variable i corresponds to the copy quantity and relates mainly to the drum characteristic. The interval count variable C corresponds to a jump quantity in copying and relates mainly to the shelf time characteristic.

At step #55, the optical system board 19 is operated to start the scanning of the original. The copying of the first sheet is performed by the scanning ($t_F$ of FIG. 12). At this time, as the control value M, the one decided at steps #5 to #42 is used. However, the scanning performed when the process returns from subsequently-described steps #75 and #90 to step #55 is for the copying of the second and succeeding sheets and in that case, as the control value M, the one corrected at steps #60 and succeeding steps is used. At step #60, the return of the optical system is sensed. This is in order to change the output control value M of the main transformer board 3 when the optical system is returned. The process to change the output control value is executed at the succeeding steps #65 to #85.

At step #65, it is determined whether or not the subtraction of the drum characteristic correction value DD and the shelf time correction value TD is finished up to the initial copy quantity count value AL. In this case, when i=0 where count has reached the set copy quantity, the process proceeds to the next step #70. When count has not reached the set copy quantity, a value decided according to i is subtracted from the sum of the drum characteristic correction value DD and the shelf time correction value TD.

For example, when ELi is $EL_3$=6, $EL_2$=3 and $EL_1$=1, from the sum of the selected drum characteristic addition data DD and shelf time characteristic addition data TD, 6 is subtracted when i=3, 3 is subtracted when i=2, and 1 is subtracted when i=1. At step #85, this subtraction is performed and i is decremented by 1. After the processing of step #85 is completed, whether correction is necessary or not is determined at step #90. Specifically, at step #90, the transformer output control value M of that time is compared with the first set value $M_0$ to determine whether or not the drum surface potential reaches the stable potential without any need for correction. When it is determined that correction is necessary, the process returns to step #55. When i=0 at step #65, whether C=0 or not is determined at step #70. When C≠0, is decremented by 1 at step #75 and the process returns to step #55. When it is determined at step #70 that C=0, the process proceeds to step #80 to subtract a predetermined value F from M, and C is re-set to BL. F is set −1 or 1 at step #25 or #30. When it is determined at step #90 that correction is unnecessary, the process proceeds to step #95 to perform the normal copying (copying without any corrections by DD and TD).

When a small size sheet is used at step #45, the process proceeds to step #50' to perform the transformer output control value controlling operation in steps #50' to #90'. This operation will not be described since it is the same as the above-described operation performed when a large size sheet is used.

In the case of the small size sheet, however, the time required for the copying of one sheet is shorter than in the case of the large size sheet, so that the subtraction of the drum characteristic and shelf time characteristic for every copying is fractional. At step #50', AS represents an initial copy quantity count value of a small-size sheet, and BS represents an interval count value of the small size sheet. ESi at step #85' represents the sum of the drum characteristic addition data and the shelf time addition data for the small size sheet.

To stabilize the drum surface potential at the developing section C, the main circuit board 20 regulates the potential when the power is activated. Specifically, as shown in FIG. 2, the grid electrode 2*c* of each charger 2 is provided for the potential regulation and connected to the main circuit board 20 through the main transformer board 3.

The main circuit board 20 transmits a grid potential control signal to control the main transformer board 3 so that the drum surface potential is a predetermined potential (e.g. 820 V) at the developing section C, and by regulating the grid voltage thereby, the drum surface potential at the charging section A is controlled. While in the above-described embodiment, the voltage applied to the chargers 2 is regulated by a transformer control signal transmitted to the main transformer board 3 through the D/A converter 26 incorporated in the main circuit board 20, the present invention may be realized by regulating the grid voltage.

Figure 13:
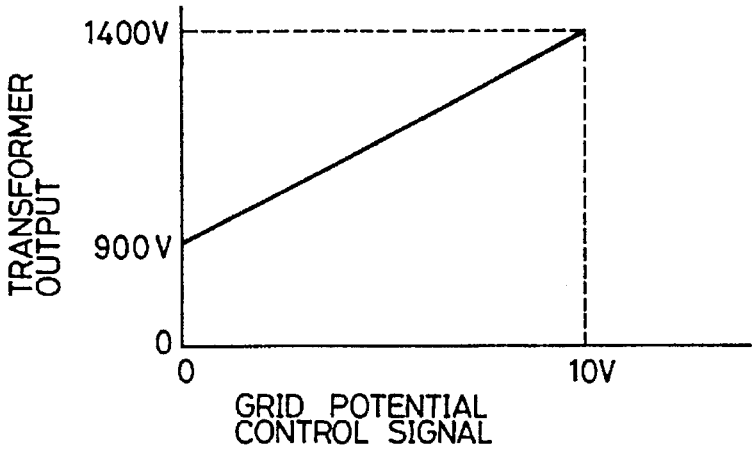
FIG. 13 is a diagram showing a relationship between a grid potential control signal and a transformer output.

Specifically, FIG. 13 shows a relationship between a D/A converted transformer output control signal and a transformer output of the main transformer board 3 supplied to the grid electrode 2*c*. As shown in the figure, an output 0 to 10 V of the transformer output control signal outputted from the main circuit board 20 proportionally corresponds to a voltage of 900 to 1400 V applied to the grid electrode 2*c* by the main transformer board 3. The drum surface potential is set to a predetermined potential by supplying a constant transformer output to each charger 2 and by controlling the grid voltage within a range of 900 to 1400 V by the grid potential control signal. Thus, the same advantages are obtained by performing the control operation by using the control value M of the transformer output of FIG. 11 as the control value of the grid electrode 2*c*.

As described above, according to the present invention, in a predetermined number of times of charging operations performed until the surface potential of the electrostatic latent image carrier reaches a stable potential level from a surface potential higher than the stable potential attributed to a rise characteristic of the surface potential of the electrostatic latent image carrier, since the output value of the voltage applying means is corrected to a voltage value necessary for the surface of the electrostatic latent image carrier to be charged at the stable potential level, control is performed in consideration of the initial drastic rise characteristic while several image forming operations are performed until the surface potential of the electrostatic latent image is stabilized, whereby the output value of the voltage applying means is reduced to a voltage value necessary for the surface of the electrostatic latent image carrier to be charged at the stable potential level. As a result, the surface of the electrostatic latent image carrier is charged at the stable potential level necessary for development from the first time and an excellent image quality is realized from the first image forming operation.

Likewise, in a plurality of times of charging operations performed until the surface potential of the electrostatic latent image carrier reaches a stable potential level from a surface potential higher than the stable potential level attributed to a rise characteristic of the surface potential of the electrostatic latent image carrier which characteristic varies according to the length of the shelf time from the end of the previous image forming process to the start of the present image forming process, since the output value of the voltage applying means is corrected to a voltage value necessary for the surface of the electrostatic latent image carrier to be charged at the stable potential level, the output value of the voltage applying means is reduced to a voltage value necessary for the surface of the electrostatic latent image carrier to be charged at the stable potential. As a result, even when the image forming process is re-started after the electrostatic latent image carrier is left deactivated for a long time, the surface of the electrostatic latent image carrier is charged at the stable potential level necessary for development and an excellent image quality is always realized.

Moreover, in a predetermined times of charging operations performed until the surface potential of the electrostatic latent image carrier reaches a stable potential level from a surface potential higher than the stable potential level attributed to a rise characteristic of the surface potential of the electrostatic latent image carrier, since the output value of the voltage applying means applied to an electrode is corrected by a charger to a value necessary for the electrostatic latent image carrier to be charged at the stable potential level, control is performed in consideration of the initial drastic rise characteristic while several image forming operations are performed until the surface potential of the electrostatic latent image is stabilized, whereby the output value of the voltage applying means is reduced to a voltage value necessary for the surface of the electrostatic latent image carrier to be charged at the stable potential level. As a result, the surface of the electrostatic latent image carrier is charged at the stable potential level necessary for development from the first time and an excellent image quality is realized from the first image forming operation.

Moreover, in a plurality of times of charging operations performed until the surface potential of the electrostatic latent image carrier reaches a stable potential level from a surface potential higher than the stable potential level attributed to a rise characteristic of the surface potential of the electrostatic latent image carrier which characteristic varies according to the length of the shelf time from the end of the previous image forming process to the start of the present image forming process, the output value of the voltage applying means applied to an electrode is corrected by a charger to a value necessary for the surface of the electrostatic latent image carrier to be charged at the stable potential level, based on the operation by the controlling means in consideration of the rise characteristic of the photosensitive layer of the electrostatic latent image carrier which characteristic is attributed to the length of the shelf time from the end of an image forming process to the start of the next image forming process, the output value of the voltage applying means applied to an electrode is reduced by the charger to a voltage value necessary for the surface of the electrostatic latent image carrier to be charged at the stable potential level. As a result, even when the image forming process is re-started after the electrostatic latent image carrier is left deactivated for a long time, the surface of the electrostatic latent image is charged at the stable potential level necessary for development and an excellent image quality is always realized.

Thus, according to the present invention, when an amorphous silicon photosensitive material is used for the surface photosensitive layer of the electrostatic latent image carrier, the effect of correcting the rise of surface potential of the electrostatic latent image carrier is remarkable.

Obviously, many modifications and variations of the present invention are possible in light of the above teachings. It is therefore to be understood that within the scope of the appended claims, the invention may be practiced other than as specifically described.

TABLE 1

| | Cm | | | Inch | |
|---|---|---|---|---|---|
| Large size | A3 | B4 | Folio | 11 × 17 | |
| Small size | A4R<br>B5R | A4<br>A5R | B5 | 8½ × 14<br>11 × 8½ | 8½ × 11<br>5½ × 8½ |

What is claimed is:

1. An image forming apparatus comprising:

an electrostatic latent image carrier which is movable so that a photosensitive layer formed on a surface of the electrostatic latent image carrier is successively charged, exposed, developed and charge-removed during an image forming process;

a charger which charges a surface of the photosensitive layer;

voltage generating means for supplying the charger with an output voltage to charge the surface of the photosensitive layer; and controlling means for correcting a value of the output voltage of the voltage generating means to a voltage value necessary for the surface of the photosensitive layer to be charged to a predetermined voltage for a predetermined number of charging operations performed until a voltage of the surface of the photosensitive layer reaches the predetermined voltage from a higher voltage than the predetermined voltage, the higher voltage being due to a rise characteristic of the electrostatic latent image carrier.

2. An image forming apparatus according to claim 1, wherein said output voltage of the voltage generating means is applied to a charging wire of the charger.

3. An image forming apparatus according to claim 1, wherein said charger has a control electrode between a charging wire and the surface of the photosensitive layer, and wherein said output voltage of the voltage generating means is applied to the control electrode.

4. An image forming apparatus according to claim 1, wherein an amount of correction by the controlling means is changed based on a voltage dark decay amount particular to the electrostatic latent image carrier.

5. An image forming apparatus according to claim 1, wherein said controlling means corrects the value of the output voltage of the voltage generating means to a voltage value necessary for the surface of the photosensitive layer to be charged to the predetermined voltage for a plurality of image forming processes performed until the voltage of the surface of the photosensitive layer reaches the predetermined voltage from the higher voltage than the predetermined voltage, the higher voltage being attributable to the rise characteristic of the electrostatic latent image carrier which depends on a length of a shelf time from an end of a previous image forming process to a present image forming process.

6. An image forming apparatus according to claim 1, wherein said photosensitive layer is made of an amorphous silicon photosensitive material.

7. An image forming apparatus according, to claim 1, wherein a control value, supplied from the controlling means to control the voltage generating means, is converted from an analog form to a digital form.

8. An image forming apparatus according to claim 1, wherein said controlling means detects a shelf time from an end of a previous image forming process to a present image forming process, and controls the charging of the surface of the photosensitive layer according to a correction control value, the correction control value being obtained by adding a correction value corresponding to the shelf time to a base control value.

9. An image forming apparatus according to claim 8, wherein said controlling means largely reduces the correction value in succession for a predetermined plurality of image forming processes succeeding a first image forming process in which the surface of the photosensitive layer is charged based on the correction control value.

10. An image forming apparatus according to claim 9, wherein a reduction value is subtracted from the correction value to largely reduce the correction value in succession, the reduction value differing according to a size of a sheet to which an image formed on the electrostatic latent image carrier is transferred through development.

11. An image forming apparatus according to claim 9, wherein, for image forming processes performed after an end of the predetermined plurality of image forming processes, the correction value is reduced by a constant value every image forming process.

12. An image forming apparatus according to claim 11, wherein a number of the image forming processes for which the correction value is reduced by the constant value differs according to a size of a sheet to which an image formed on the electrostatic latent image carrier is transferred through development.

13. A voltage control apparatus, for use with an image forming apparatus provided with:

an electrostatic latent image carrier having a surface with a photosensitive layer formed thereon, the electrostatic latent image carrier being movable, in order, through at least a charging section, an exposing section, a developing section and a charge removing section so as to return to the charging section; and operation means for starting an image forming operation, in which an image forming process is repeated an arbitrary number of times, during which image forming process a surface of the photosensitive layer is charged by a charger provided in the charging section, an electrostatic latent image is formed on the charged surface of the photosensitive layer at the exposing section, the electrostatic latent image is developed into a toner image at the developing section, and a residual charge on the surface of the photosensitive layer is removed at the charge removing section so as to be ready for a next charging, the voltage control apparatus comprising:

voltage applying means for applying to the charger an output voltage to charge the surface of the photosensitive layer; and controlling means for correcting a value of the output voltage of the voltage applying means to a voltage value necessary for the surface of the photosensitive layer to be charged to a stable voltage for a predetermined number of charging operations performed after a start of an image forming process until a voltage of the surface of the photosensitive layer reaches the stable voltage from a higher voltage than the stable voltage, the higher voltage being attributable to a rise characteristic of the photosensitive layer.

14. A voltage control apparatus, for use with an image forming apparatus provided with:

an electrostatic latent image carrier having a surface with a photosensitive layer formed thereon, the electrostatic latent image carrier being movable, in order, through at least a charging section, an exposing section, a developing section and a charge removing section so as to return to the charging section; and operation means for starting an image forming operation, in which an image forming process is repeated an arbitrary number of times, during which image forming process a surface of the photosensitive layer is charged by a charger provided in the charging section, an electrostatic latent image is formed on the charged surface of the photosensitive layer at the exposing section, the electrostatic latent image is developed into a toner image at the developing section, and a residual charge on the surface of the photosensitive layer is removed at the charge removing section to be ready for a next charging, the voltage control apparatus comprising:

voltage applying means for applying to the charger an output voltage to charge the surface of the photosensitive layer; and controlling means for correcting a value of the output voltage of the voltage applying means to a voltage value necessary for the surface of the photosensitive layer to be charged to a stable voltage for a plurality of image forming processes performed until a voltage of the surface of the photosensitive layer reaches the stable voltage from a higher voltage than the stable voltage, the higher voltage being attributable to a rise characteristic of the electrostatic latent image carrier which characteristic varies according to a length of a shelf time from an end of a previous image forming process to a start of a present image forming process.

15. A voltage control apparatus, for use with an image forming apparatus provided with:

an electrostatic latent image carrier having a surface with a photosensitive layer formed thereon, the electrostatic latent image carrier being movable, in order, through at least a charging section, an exposing section, a developing section and a charge removing section so as to return to the charging section; and operation means for starting an image forming operation, in which an image forming process is repeated an arbitrary number of times, during which image forming process a surface of the photosensitive layer is charged by a charger provided in the charging section, an electrostatic latent image is formed on a charged surface of the photosensitive layer at the exposing section, the electrostatic latent image is developed into a toner image at the developing section, and a residual charge on the surface of the photosensitive layer is removed at the charge removing section to be ready for a next charging, the voltage control apparatus comprising:

an electrode provided between the charger and the surface of the photosensitive layer;

voltage applying means for applying an output voltage to the electrode; and controlling means for correcting a value of the output voltage of the voltage applying means applied to the electrode to a voltage value necessary for the surface of the photosensitive layer to be charged by the charger to a stable voltage for a predetermined number of charging operations performed after a start of an image forming process until a voltage of the surface of the photosensitive layer reaches the stable voltage from a higher voltage than the stable voltage, the higher voltage being attributable to a rise characteristic of the electrostatic latent image carrier.

16. A voltage control apparatus, for use with an image forming apparatus provided with:

an electrostatic latent image carrier having a surface with a photosensitive layer formed thereon, the electrostatic latent image carrier being movable, in order, through at least a charging section, an exposing section, a developing section and a charge removing section so as to return to the charging section; and operation means for starting an image forming operation, in which an image forming process is repeated an arbitrary number of times, during which image forming process a surface of the photosensitive layer is charged by a charger provided in the charging section, an electrostatic latent image is formed on the charged surface of the photosensitive layer at the exposing section, the electrostatic latent image is developed into a toner image at the developing section, and a residual charge on the surface of the photosensitive layer is removed at the charge removing section to be ready for a next charging, the voltage control apparatus comprising:

an electrode provided between the charger and the surface of the photosensitive layer;

voltage applying means for applying an output voltage to the electrode; and controlling means for correcting a value of the output voltage of the voltage applying means applied to the electrode to a voltage value necessary for the surface of the photosensitive layer to be charged by the charger to a stable voltage for a plurality of image forming processes performed until a voltage of the surface of the photosensitive layer reaches the stable voltage from a higher voltage than the stable voltage, the higher voltage being attributable to a rise characteristic of electrostatic latent image carrier which characteristic varies according to a length of a shelf time from an end of a previous image forming process to a start of a present image forming process.

17. A voltage control apparatus, for use with an image forming apparatus provided with:

an electrostatic latent image carrier having a surface with a photosensitive layer formed thereon, the electrostatic latent image carrier being movable, in order, through at least a charging section, an exposing section, a developing section and a charge removing section so as to return to the charging section; and operation means for starting an image forming operation, in which an image forming process is repeated an arbitrary number of times, during which image forming process a surface of the photosensitive layer is charged by a charger provided in the charging section, an electrostatic latent image is formed on the charged surface of the photosensitive layer at the exposing section, the electrostatic latent image is developed into a toner image at the developing section, and a residual charge on the surface of the photosensitive layer is removed at the charge removing section to be ready for a next charging, the voltage control apparatus comprising:

voltage applying means for applying to the charger an output voltage to charge the surface of the photosensitive layer; and controlling means for correcting a value of the output voltage of the voltage applying means for a predetermined number of charging operations performed until a voltage of the surface of the photosensitive layer reaches a stable voltage, wherein an amount of correction of the value of the output voltage by the controlling means is varied according to a dark decay amount particular to the electrostatic latent image carrier.

18. A voltage control apparatus, for use with an image forming apparatus provided with:

an electrostatic latent image carrier having a surface with a photosensitive layer formed thereon, the electrostatic latent image carrier being movable, in order, through at least a charging section, an exposing section, a developing section and a charge removing section so as to return to the charging section; and operation means for starting an image forming operation, in which an image forming process is repeated an arbitrary number of times, during which image forming process a surface of the photosensitive layer is charged by a charger provided in the charging section, an electrostatic latent image is formed on the charged surface of the photosensitive layer at the exposing section, the electrostatic latent image is developed into a toner image at the developing section, and a residual charge on the surface of the photosensitive layer is removed at the charge removing section to be ready for a next charging, the voltage control apparatus comprising:

an electrode provided between the charger and the surface of the photosensitive layer;

voltage applying means for applying an output voltage to the electrode; and controlling means for correcting a value of the output voltage of the voltage applying means applied to the electrode to a voltage value necessary for the surface of the photosensitive layer to be charged by the charger to a stable voltage for a predetermined number of charging operations performed until a voltage of the surface of the photosensitive layer reaches the stable voltage, wherein an amount of correction by the controlling means is varied according to a dark decay amount particular to the electrostatic latent image carrier.

* * * * *